United States Patent [19]

Lindholm

[11] Patent Number: 4,467,678

[45] Date of Patent: Aug. 28, 1984

[54] TORQUE WRENCH

[75] Inventor: Wayne R. Lindholm, Palatine, Ill.

[73] Assignees: Frank G. Eskuchen, Coral Gables, Fla.; Leonard G. Eskuchen, Arlington Heights; Raymond F. Eskuchen, Glenview, both of Ill.

[21] Appl. No.: 412,126

[22] Filed: Aug. 27, 1982

[51] Int. Cl.[3] ..... B25B 23/142

[52] U.S. Cl. ..... 81/483

[58] Field of Search ..... 81/483, 478, 474

[56] References Cited

U.S. PATENT DOCUMENTS

| | | | |
|---|---|---|---|
| 3,272,002 | 9/1966 | Dickman | 81/483 |
| 3,577,815 | 5/1971 | Bergquist | 81/483 |
| 3,599,515 | 8/1971 | Grabovac | 81/483 |
| 4,126,062 | 11/1978 | Solomon | 81/483 |
| 4,207,783 | 6/1980 | Grabovac | 81/483 |
| 4,403,531 | 9/1983 | Bailey et al. | 81/483 |

*Primary Examiner*—James L. Jones, Jr.

*Attorney, Agent, or Firm*—Fitch, Even, Tabin & Flannery

[57] ABSTRACT

A torque wrench including a drive head defining a torque transfer axis and having a shank generally coaxial within and pivotally connected to a tubular handle, and coupling means including a spherical coupling member releasably interconnecting the shank and handle so as to effect pivotal movement of the handle and create an audible indication to the operator when a predetermined but selectively variable torque is applied at the torque transfer axis in either rotational direction. A tubular auxiliary handle is adapted for telescoping relation with the primary handle and enables torque multiplication.

9 Claims, 8 Drawing Figures

12
10
20
14
3
3
26
80
70
60
50
40
54
50c
50d
50
50e
66

12
16
18
20
14
30
28
26a
26

28
14
26a
30

12
20
30
28
26a
14
26
26a
14a
38
34
36
40b
40a
40
40c
46

48b
48
48a
48c 48a
48b
48
48c

TORQUE WRENCH

BACKGROUND OF THE INVENTION

The present invention relates generally to torque wrenches, and more particularly to a novel torque wrench adapted to apply a torque in either rotational direction and which may be adjusted to establish a predetermined torque at which an audible noise is provided to indicate to the operator that the selected torque limit has been reached.

It is a conventional practice in many manufacturing processes to employ torque wrenches which enable the tightening of threaded fasteners such as screws and bolts and the like to predetermined tightness through the application of a predetermined torque. Torque wrenches are known which include indicators adapted to provide a visual indication to the operator of the torque being applied so that the operator does not apply a greater torque than intended. While such torque wrenches have proven satisfactory where visual observation of the indicator is unobstructed, obvious drawbacks exist where visual observation of the torque indicator is obstructed or otherwise made difficult. To overcome this problem, torque wrenches have been developed which provide a non-visual indication to the operator when a predetermined torque has been reached, such as an audible "click" or a movement providing "feel" to the operator when the predetermined torque has been reached. See, for example, U.S. Pat. Nos. 2,786,378, 3,165,014, and 3,577,815.

While the known torque wrenches which provide an audible and/or sensory "feel" indication to an operator when a predetermined torque has been reached have been generally satisfactory in operation, the known devices have, for the most part, employed rather complex structures which are relatively costly to manufacture and thus not economically practical for purchase by the average hobbyist or person having relatively infrequent need for such a tool.

SUMMARY OF THE INVENTION

One of the primary objects of the present invention is to provide a novel torque wrench of relatively simple construction which provides an audible indication to the operator when a predetermined torque has been attained during a torquing operation.

A more particular object of the present invention is to provide a novel torque wrench of relatively simple construction which is adjustable to selectively vary the torque at which the torque wrench will provide both an audible and sensory "feel" indication to the operator when a predetermined torque has been reached in either rotational direction.

A feature of the torque wrench in accordance with the present invention lies in the provision of a spherical coupling member interposed between a free end of a shank fixed to a conventional ratchet head and an operating handle pivotally connected to and coaxial over the shank and carrying a follower which acts against the spherical member so as to maintain the spherical member within mutually opposed generally semispherical recesses in the shank and follower until a predetermined torque is reached at which time the operating handle pivots relative to the shank with a resultant "click" of the shank against the inner surface of the handle to provide an audible and sensory feel indication to the operator that the predetermined torque has been reached.

Another feature of the torque wrench in accordance with the present invention lies in providing in the end of the shank a recess for the spherical coupling member which is sized to receive approximately one half of the spherical coupling member so as to prevent release thereof, the segmental spherical recess in the opposed follower member being relatively shallow such that the spherical member effects a cammed movement of the follower member to enable relative pivotal movement between the shank and the operating handle when a predetermined torque is attained.

Still another feature of the present invention lies in the provision of means for adjusting the biasing force applied by the follower member against the spherical coupling member in a manner which simultaneously varies the orientation of the segmental spherical surface in the follower relative to the spherical coupling member during release, thereby substantially reducing the rate of wear with corresponding prolonged life of the torque wrench and accurate operation thereof.

Yet another feature of the torque wrench in accordance with the present invention lies in the provision of an auxiliary handle adapted for telescoping relation with the primary operating handle so as to enable a compact storage position while facilitating extension to provide a predetermined torque multiplication.

Further objects, advantages and features of the present invention, together with the organization and the manner of operation thereof, will become apparent from the following detailed description of the invention when taken in conjunction with the accompanying drawings wherein like reference numerals designate like elements throughout the several views.

DESCRIPTION OF PREFERRED EMBODIMENT

Figure 1:
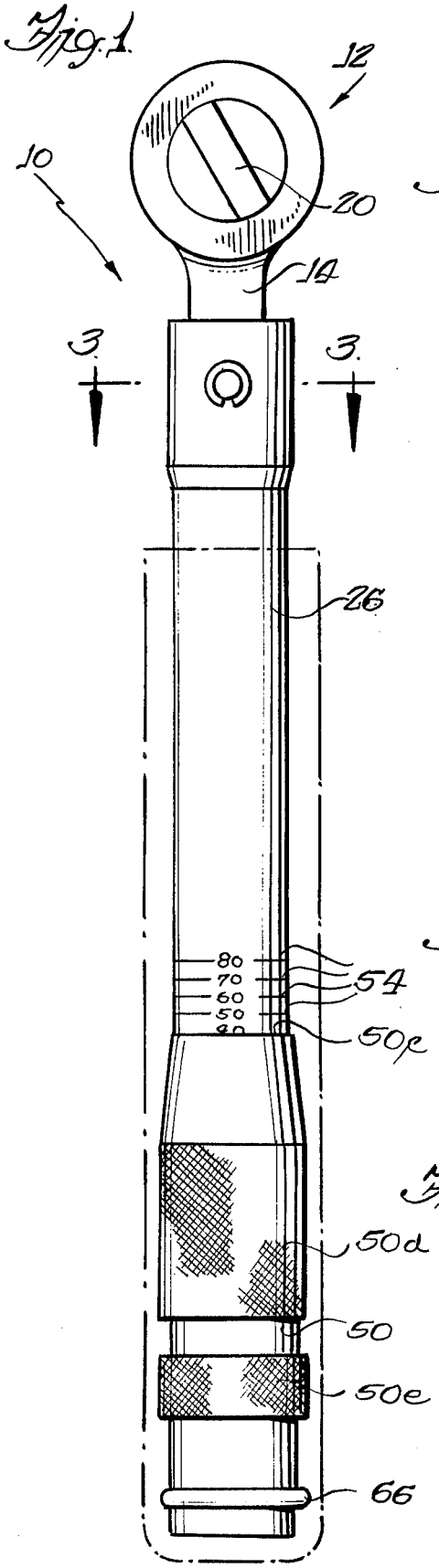
FIG. 1 is a plan view of a torque wrench constructed in accordance with the present invention, an auxiliary handle being illustrated in phantom in its telescoped storage position on the primary operating handle.
Figure 2:
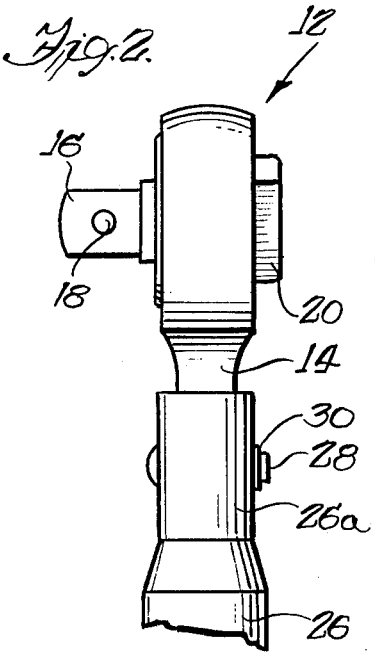
FIG. 2 is a fragmentary side elevational view of the ratchet end of the torque wrench of FIG. 1.

Referring now to the drawings, and in particular to FIG. 1, a torque wrench constructed in accordance with the present invention is indicated generally at 10. The torque wrench 10 is of the type having torque applying means in the form of a drive head or ratchet head, indicated generally at 12, which is formed integral with or otherwise suitably secured to one end of an elongated shank 14. The drive head 12 is of conventional construction and has a lateral drive extension 16 which, in the illustrated embodiment, is of square cross section for releasable engagement with conventional socket members. A detent ball 18 is retained within a suitable blind bore in the drive extension 16 and is urged outwardly by a concealed spring (not shown) so as to facilitate releasably retention of a socket or the like on the drive extension 16 as is known. The drive head 12 has a conventional ratchet mechanism (not shown) internally thereof operative through a thumb control 20 to enable reversal of the direction of torque application through the torque transfer axis defined by the drive extension 16. It will be appreciated that the drive extension 16, while shown as having a generally squared transverse cross section, may have any desired configuration compatible with a tool or fastener with which the torque wrench is to be employed.

Figure 3:
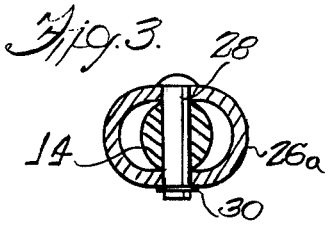
FIG. 3 is a transverse sectional view taken substantially along line 3—3 of FIG. 1, looking in the direction of the arrows.
Figure 7:
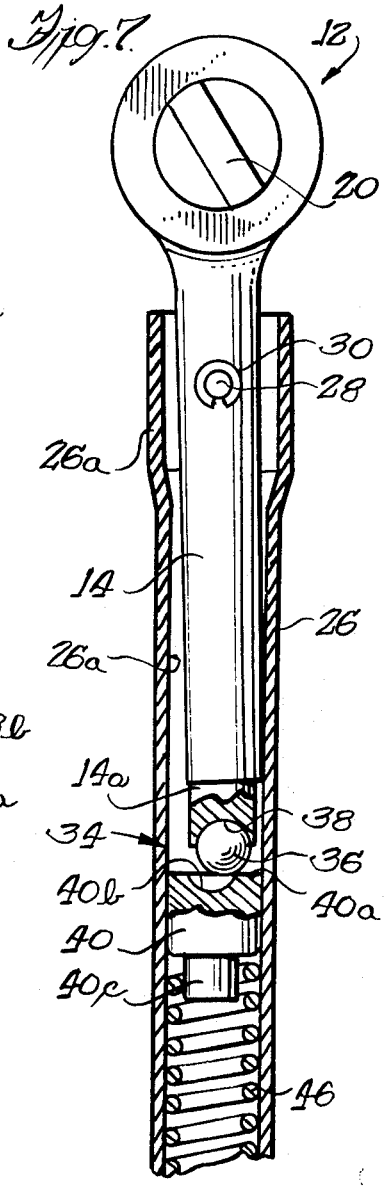
FIG. 7 is a fragmentary longitudinal sectional view of the torque wrench of FIG. 1 showing the various components in positions wherein a predetermined torque has been reached during a torquing operation.
Figure 6:
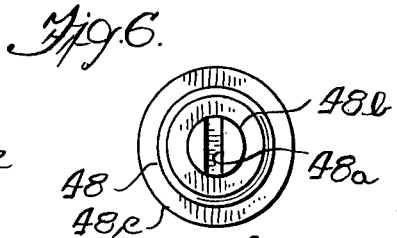
FIG. 6 is an end view of the spring seat illustrated in FIG. 5.
Figure 5:
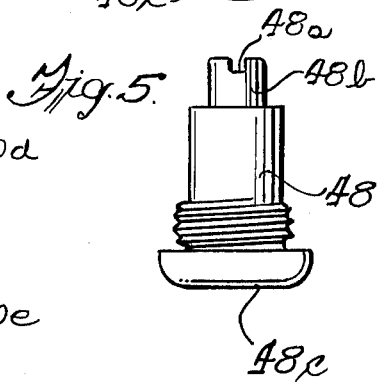
FIG. 5 is a detail view of the spring seat and end cap employed in the torque wrench of FIG. 1.
Figure 4:
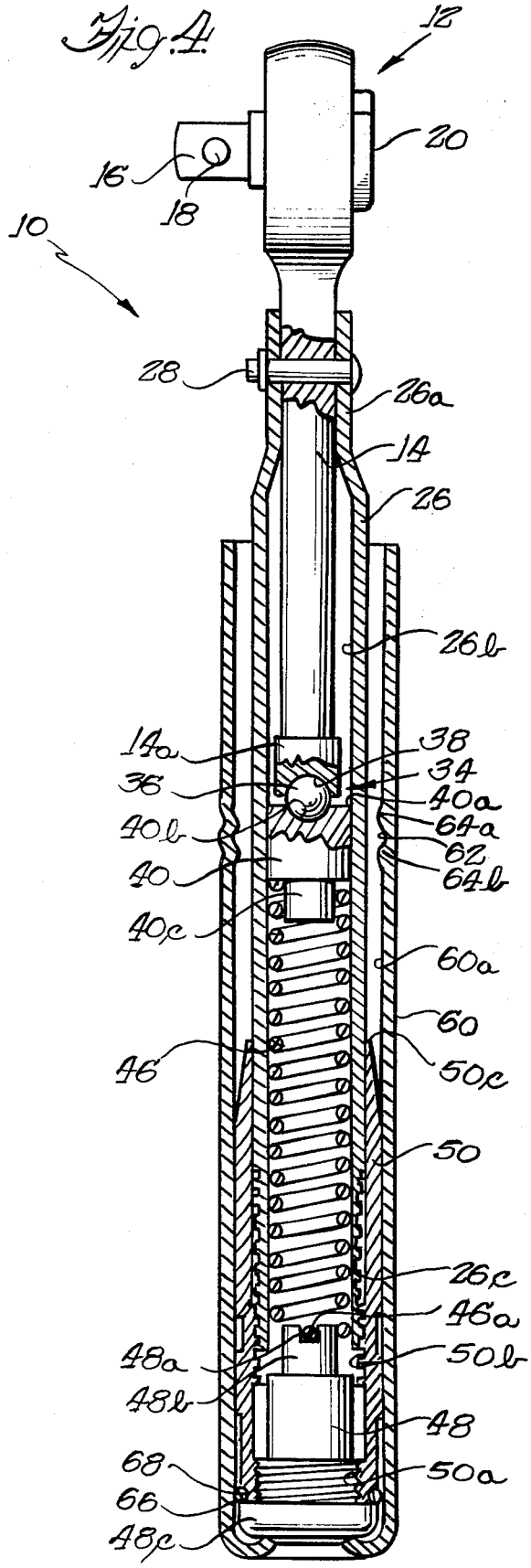
FIG. 4 is a side elevational view of the torque wrench illustrated in FIG. 1 but with a portion in longitudinal section.

The shank 14, which may alternatively be termed a torque arm, is of predetermined length and lies in a plane substantially normal to the torque axis defined by the lateral drive extension 16. In the illustrated embodiment, the shank 14 is substantially cylindrical and receives a generally tubular handle 26 coaxially thereover. The handle 26 is pivotally connected to the shank 14 generally adjacent the drive head through a headed pivot pin 28 received through suitable aligned bores in the shank and handle and retained therein by a retainer ring 30. As illustrated in FIGS. 3 and 4, the pivot end **26*a* of handle 26 is partially flattened to form a generally oval shaped end through which the pivot pin 28 extends and which facilitates relative pivotal movement between the handle and the shank. The remaining length of handle 26 is generally cylindrical and has an internal surface 26*b* of predetermined diameter relative to the shank 14 so as to provide predetermined limited pivotal movement of handle 26 relative to the shank in either pivotal direction, considered in a plane transverse to the pivot axis 28**.

In accordance with the present invention, the handle 26 is releasably interconnected to the shank 14 through coupling means, indicated generally at 34, which is operative to maintain the shank and handle in substantially fixed axially aligned relation to each other when a force below a predetermined force is applied to the handle during a torquing operation, but which operates to effect relative movement between the shank and handle when the force applied to the handle establishes a torque through the drive extension 16 greater than a predetermined torque. As will become more apparent hereinbelow, when a predetermined torque applied through the drive extension 16 is attained the coupling means 34 releases the handle 26 from its generally axially aligned relation with the shank 14 such that the handle undergoes pivotal movement about the pivot axis 28 relative to the shank and causes the free end 14 of the shank to engage the inner surface of the handle and provide an audible "click" and corresponding sensory feel to the operator that the predetermined torque has been reached.

Referring particularly to FIG. 4, the coupling means 34 includes a spherical coupling member 36 which seats within a semispherical recess 38 formed within the free end **14*a* of shank 14. The recess 38 has a radius of curvature substantially equal to the radius of the spherical coupling member 36 and having a depth substantially equal to its radius so that the recess 38** receives approximately one-half of the spherical coupling member therein.

The spherical coupling member 36 is urged into the recess 38 by a generally cylindrical follower 40 having an outer diameter slightly smaller than the diameter of the inner surface **26*b* of handle 26 so as to facilitate sliding movement of the follower relative to the handle. The follower 40 has an end surface 40*a* transverse to its longitudinal axis and in which is formed a segmental spherical recess 40*b* having a radius substantially equal to the radius of the spherical coupling member 36 and having a depth equal to approximately one-fourth the diameter of the spherical coupling member 36. The spherical coupling member 34 is preferably made from a suitable hardened steel and the follower 40 is similarly made from a hardened steel such that the recess surface 40*b* has a hardness of approximately RC 65**.

The follower 40 is urged against the spherical coupling member 36 so as to maintain the coupling member within the recesses 38 and **40*b* by resilient means in the form of a coil compression spring 46. One end of the spring is received over a cylindrical boss or pilot shank 40*c* formed on the follower in tight frictional relation thereon so that rotation of the compression spring effects a corresponding rotational movement of the follower 40 about its longitudinal axis. The opposite end of the compression spring 46 has an end 46*a* lying on a diameter of the coil and received within a cross slot 48*a* formed in an end 48*b* of a spring seat and end cap 48 which is threadedly connected within an internally threaded bore 50*a* formed in a tubular cylindrical handle portion or sleeve 50. The transverse slot 48*a* enables insertion of an assembly tool, such as a conventional screwdriver, internally of the handle portion 50 to facilitate assembly of the end cap 48 within the threaded bore 50*a* of the handle portion 50**.

The handle portion 50, which comprises an adjustable handle portion of the torque wrench, has a square tooth internal thread **50*b* which threadedly mates with a complimentary external square thread 26*c* formed on the free end of handle 26. In this manner, rotation of the adjustable handle portion 50 relative to the tubular handle 26 is operative to rotate follower 40 and also vary the compression of spring 46 so as to selectively vary the force applied by the follower against the coupling member 36 seated within recess 38 in shank 14**.

It will be appreciated that during operation of the torque wrench 10 in applying torque to a tool or workpiece through the drive extension 16 in either rotational direction, the spherical coupling member 36 will remain seated within the mutually opposed recesses 38 and **40*b* until a predetermined torque is reached, at which time continued application of force to the handle sufficient to further increase the torque causes the spherical coupling member 36 to move follower 40 longitudinally in a camming action against the compression spring 46 and thereby release the handle for pivotal movement relative to shank 14. The diameters of the shank free end 14*a* and the handle inner surface 26*b* are selected such that the free end of the shank will engage the inner surface of the handle at substantially the moment at which the spherical coupling member 36 cams the follower 40 away from the free end of the shank so as to effect an audible "click" against the handle and thereby provide both an audible and sensory feel indication to the operator that a predetermined torque has been reached. During such camming movement of the follower 40** enabling relative movement between the handle 26 and shank 14, the spherical coupling member 36 remains within the semispherical recess 38 as it rides up the recess surface 40*b* to force the follower 40 longitudinally away from the shank.

It will be appreciated that the force applied to handle 26 at which the follower 40 is cammed away from the shank 14 by the spherical coupling member 36, i.e., the torque at which an audible click is created, is established by predetermined selection of the compression spring 46 and the rotational adjustment of handle portion 50 on the threaded end 26*d* of handle 26. To provide a visual indication of the selected torque limit at which the handle will release from shank 14, circular torque value indicating lines or markings 54 are formed on the external surface of handle 26 in position for registration with an end surface 50*c* on the adjustable handle portion 50. In this manner, the operator can adjust the torque wrench for a desired torque at which an audible indication will be given to indicate when the predetermined torque has been applied, it being understood that proper calibration is first necessary in selection of spring 46.

Figure 8:
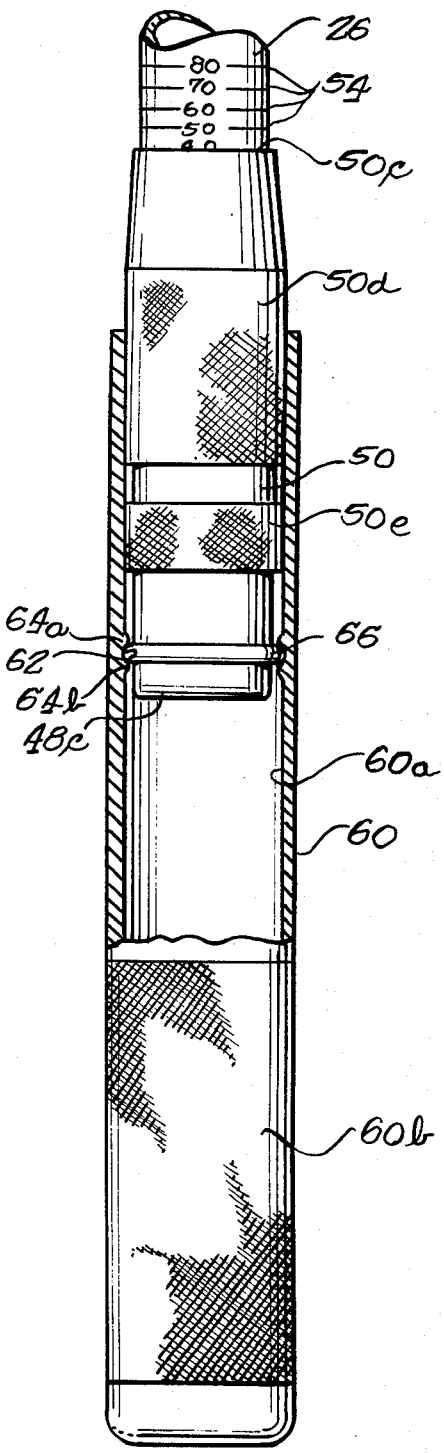
FIG. 8 is a fragmentary plan view illustrating the auxiliary handle in an extended position, portions being broken away for purposes of clarity.

In accordance with one feature of the torque wrench 10, a tubular auxiliary handle 60 is adapted for cooperation with the primary handle 26 so as to enable coaxial telescoping relation therewith between a first position wherein the auxiliary handle is substantially fully telescoped over the handle, as illustrated in FIG. 4, and an extended position wherein the auxiliary handle provides an extension of handle 26 to enable torque multiplication, as illustrated in FIG. 8. To this end, the auxiliary handle 60 comprises a cylindrical tubular sleeve having an internal cylindrical surface 60*a* which facilitates longitudinal telescoping movement of the auxiliary handle over equal diameter external surfaces 50*d* and 50*e* on the adjustable handle portion 50. The auxiliary handle 60 has an internal annular recess or radial depression 62 formed by upsetting the auxiliary handle as at 64*a* and 64*b*. The recess 62 is adapted to receive an annular neoprene O-ring 66 therein when the auxiliary handle is extended longitudinally outwardly on the handle 26, the O-ring 66 being retained within a suitable recess 68 formed in the outer end of handle 50. The spring seat and end cap 48 preferably has an enlarged head 48*c* to assist in retaining the O-ring 66 within the recess 68.

The length of the auxiliary handle 60 and the relative position of the internal recess 62 therein are selected such that with the auxiliary handle 60 in its extended position, as illustrated in FIG. 8, a force applied against an external knurled surface 60*b* will provide a predetermined torque multiplication at the drive extension 16 over the torque applied when the auxiliary handle is in its telescoped position as illustrated in FIG. 4. Such multiplication is preferably a whole multiplier such as two.

Thus, in accordance with the present invention, a torque wrench is provided with is relatively simple and economical in construction and is adapted to establish an audible "click" and corresponding sensory feel when a predetermined torque has been applied to a tool or workpiece in either rotational direction. By employing the spherical coupling member 36 having approximately one-half of its surface received within the recess in the shank 14, the spherical coupling member will remain within the recess in the shank when the predetermined torque is reached and the follower member 40 is cammed away from the shank to enable relative pivotal movement between the handle and shank. By providing for rotation of follower 40 during adjustment of the release torque to different torque values, the surface portion of the recess 40*b* over which the spherical coupling member 36 travels during a release movement is continually changed so as to minimize wear and thereby prolong accurate operation of the torque wrench.

While a preferred embodiment of the present invention has been illustrated and described, it will be understood to those skilled in the art that the changes and modifications may be made therein without departing from the invention and its broader aspects. Various features of the invention are defined in the following claims.

What is claimed is:

1. In a torque wrench including a drive head defining a torque transfer axis and adapted to transfer torque to a workpiece and the like, a shank connected to said drive head so as to lie in a plane substantially normal to said torque transfer axis and having a free end spaced from said drive head, a tubular handle disposed generally coaxially over said shank and pivotally connected thereto for pivotal movement relative to said shank about a pivot axis substantially transverse to the longitudinal axis of said shank, and coupling means releasably interconnecting said shank to said handle so as to maintain said shank and said handle in substantially fixed relation to each other when a force is applied to said handle in a direction to establish a torque less than a predetermined torque at said torque transfer axis, said coupling means being operative to enable relative movement between said shank and said handle when the force applied to said handle effects a torque at said torque transfer axis greater than said predetermined torque; the improvement wherein said coupling means comprises a follower longitudinally slidable within said tubular handle and having an end surface opposed to said free end of said shank, means cooperative with said handle and said follower so as to selectively bias said follower toward said free end of said shank, said free end of said shank having a first semispherical recess of a predetermined diameter and depth formed therein, said end surface of said follower having a second generally semispherical recess of said predetermined diameter but of a depth less than the depth of said first recess, and a spherical coupling member mutually received within said first and second recesses and having a diameter substantially equal to said predetermined diameter, said spherical member being cooperative with said shank and said follower so as to maintain said shank and handle in substantially fixed relation until a predetermined torque is established at said drive head whereupon said spherical member cams said follower away from said free end of said shank to enable pivotal movement of the handle relative to the shank and cause said shank to engage the inner surface of said tubular handle to effect an audible indication that said predetermined torque has been reached.

2. A torque wrench as defined in claim 1 wherein said biasing means includes an adjustable handle portion mounted on an end of said tubular handle opposite its pivotal connection to said shank, said adjustable handle portion being substantially coaxial with said tubular handle and rotatable about its longitudinal axis relative to said handle, a coil compression spring having a first end cooperative with said adjustable handle portion and having an opposite second end cooperative with said follower, said adjustable handle portion being operative upon rotation relative to said tubular handle to vary the biasing force applied by said follower against said spherical coupling member.

3. A torque wrench as defined in claim 2 wherein said compression spring is generally fixed to said adjustable handle portion and said follower such that rotation of said adjustable handle portion about its longitudinal axis effects a corresponding rotation of said follower about its longitudinal axis relative to said tubular handle.

4. A torque wrench as defined in claim 3 wherein said adjustable handle portion has a transverse slot internally thereof adapted for cooperation with said compression spring so as to fixedly rotatably couple said rotatable handle portion to said coil compression spring.

5. A torque wrench as defined in claim 1 wherein said first spherical recess has a depth equal to approximately one-half the diameter of said spherical coupling member, said second recess having a depth less than one-half the diameter of said spherical coupling member such that when said predetermined torque is reached, said coupling member releases only from said second recess.

6. A torque wrench as defined in claim 3 wherein said tubular handle has external threads formed on its outer peripheral surface, said adjustable handle portion having internal threads formed therein cooperable with said external threads on said tubular handle so as to effect relative longitudinal movement between said adjustable handle portion and said tubular handle upon relative rotation therebetween.

7. A torque wrench as defined in claim 4 wherein said adjustable handle portion has a removable end cap having threaded engagement with said adjustable handle portion adjacent one end thereof, said end cap defining a boss extending axially within said adjustable handle portion and defining said transverse slot in an exposed end of said boss, said transverse slot enabling insertion of an assembly tool internally of said adjustable handle portion for cooperation with said transverse slot to facilitate rotation thereof during assembly onto said adjustable handle portion.

8. A torque wrench as defined in claim 1 wherein said tubular handle comprises a primary handle, said biasing means including a generally tubular adjustable handle portion mounted coaxially on said primary handle adjacent an end thereof opposite said pivotal connection to said shank, and including a tubular auxiliary handle adapted to telescope over said primary handle and said adjustable handle portion, said auxiliary handle being adapted for telescoping relation between a first position substantially fully telescoped over said primary handle and a second position forming a longitudinal extension of said primary handle, said adjustable handle portion and said auxiliary handle having mutually cooperable means adapted to releasably retain said auxiliary handle in its extended position relative to said primary handle.

9. A torque wrench as defined in claim 8 wherein said adjustable handle portion has an annular groove formed therein, said auxiliary handle having an internal annular recess formed therein, and including an annular member mounted within said annular groove in said adjustable handle portion for releasable cooperation with said annular recess in said auxiliary handle when moved to said second position relative to said primary handle.

* * * * *